US010533277B2

(12) United States Patent
Lyu

(10) Patent No.: US 10,533,277 B2
(45) Date of Patent: Jan. 14, 2020

(54) CONTROL METHOD OF LAUNDRY TREATMENT APPARATUS

(71) Applicant: LG ELECTRONICS INC., Seoul (KR)

(72) Inventor: Hyunkwan Lyu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/868,233

(22) Filed: Jan. 11, 2018

(65) Prior Publication Data

US 2018/0202096 A1 Jul. 19, 2018

(30) Foreign Application Priority Data

Jan. 13, 2017 (KR) ..... 10-2017-0005943

(51) Int. Cl.
*D06F 58/28* (2006.01)
*D06F 58/26* (2006.01)

(52) U.S. Cl.
CPC ..... *D06F 58/28* (2013.01); *D06F 58/26* (2013.01); *D06F 2058/289* (2013.01);
(Continued)

(58) Field of Classification Search
CPC .. D06F 58/28; D06F 58/26; D06F 2058/2816; D06F 2058/2819;
(Continued)

(56) References Cited

U.S. PATENT DOCUMENTS 3,621,202 A * 11/1971 Gernert ..... D06F 58/28 219/400
4,397,101 A * 8/1983 Rickard ..... D06F 58/28 34/486

(Continued)

FOREIGN PATENT DOCUMENTS

EP 0 428 846 5/1991
EP 1 508 637 2/2005

(Continued)

OTHER PUBLICATIONS

European Search Report dated May 29, 2018 issued in Application No. 17209509.3.

*Primary Examiner* — Stephen M Gravini
(74) *Attorney, Agent, or Firm* — KED & Associates LLP

(57) ABSTRACT

A control method of a laundry treatment apparatus is disclosed which includes a hot air supply procedure for supplying heated air to a drum through operation of a heating unit, a dryness measurement procedure for measuring dryness of laundry, a first heating unit control procedure executed when the measured dryness is lower than a reference dryness, to complete operation of the heating unit when the measured temperature reaches a first temperature and to operate the heating unit when the measured temperature reaches a second temperature lower than the first temperature, and a second heating unit control procedure executed when the measured dryness is equal to or higher than the reference dryness, to complete operation of the heating unit when the measured temperature reaches a third temperature lower than the second temperature and to operate the heating unit when the measured temperature reaches a fourth temperature lower than the third temperature.

20 Claims, 3 Drawing Sheets

(52) U.S. Cl.
CPC ..... *D06F 2058/2819* (2013.01); *D06F 2058/2829* (2013.01); *D06F 2058/2851* (2013.01)

(58) Field of Classification Search
CPC ..... D06F 2058/2829; D06F 2058/2851; D06F 2058/289; D06F 2058/2896
USPC ..... 34/495, 595–610
See application file for complete search history.

(56) References Cited

U.S. PATENT DOCUMENTS

| | | | | |
|---|---|---|---|---|
| 4,991,313 | A * | 2/1991 | Joslin | D06F 58/28 34/555 |
| 6,199,300 | B1 | 3/2001 | Heater et al. | |
| 6,928,749 | B2 * | 8/2005 | Park | D06F 58/28 34/491 |
| 6,931,760 | B2 * | 8/2005 | Yang | D06F 58/28 307/650 |
| 7,228,647 | B2 * | 6/2007 | Hong | D06F 58/24 34/596 |
| 7,322,126 | B2 * | 1/2008 | Beaulac | D06F 58/28 34/554 |
| 7,941,937 | B2 * | 5/2011 | Do | D06F 58/28 219/201 |
| 8,732,979 | B2 * | 5/2014 | Ashrafzadeh | D06F 58/04 34/601 |
| 8,778,089 | B2 * | 7/2014 | Park | A47L 15/0026 134/105 |
| 8,800,164 | B2 * | 8/2014 | Kim | D06F 25/00 137/597 |
| 9,200,842 | B2 * | 12/2015 | Hopkins | D06F 58/28 |
| 9,334,601 | B2 * | 5/2016 | Doh | D06F 29/00 |
| 9,353,992 | B2 * | 5/2016 | Carow | F26B 21/10 |
| 9,657,430 | B2 * | 5/2017 | Lee | D06F 58/206 |
| 9,657,433 | B2 * | 5/2017 | Doh | D06F 58/28 |
| 9,670,613 | B2 * | 6/2017 | Ko | D06F 58/203 |
| 9,689,109 | B2 * | 6/2017 | Lyu | D06F 73/02 |
| 9,745,690 | B2 * | 8/2017 | Lee | D06F 58/20 |
| 9,856,596 | B2 * | 1/2018 | Kim | D06F 58/28 |
| 10,087,572 | B2 * | 10/2018 | Bilionis | D06F 58/28 |
| 10,113,262 | B2 * | 10/2018 | Wen | D06F 58/28 |
| 10,151,061 | B1 * | 12/2018 | Farrel | D06F 58/28 |
| 10,196,774 | B2 * | 2/2019 | Jung | D06F 58/206 |
| 10,240,276 | B2 * | 3/2019 | Ryoo | D06F 58/24 |
| 2018/0112350 | A1 * | 4/2018 | Park | D06F 58/10 |
| 2018/0135235 | A1 * | 5/2018 | Yu | D06F 58/28 |
| 2018/0202096 | A1 * | 7/2018 | Lyu | D06F 58/28 |
| 2018/0282934 | A1 * | 10/2018 | Kamii | D06F 58/28 |
| 2018/0320304 | A1 * | 11/2018 | Vitali | D06F 58/28 |
| 2019/0003108 | A1 * | 1/2019 | Lee | D06F 58/206 |

FOREIGN PATENT DOCUMENTS

| | | | | |
|---|---|---|---|---|
| EP | 2 610 400 | | 7/2013 | |
| EP | 3348706 | A1 * | 7/2018 | D06F 58/28 |
| EP | 3428335 | A1 * | 1/2019 | D06F 58/203 |
| EP | 3000930 | B1 * | 2/2019 | D06F 73/02 |
| KR | 20140095741 | A * | 8/2014 | D06F 58/203 |

* cited by examiner

CONTROL METHOD OF LAUNDRY TREATMENT APPARATUS

CROSS-REFERENCE TO RELATED APPLICATION

This application claims the benefit of Korean Patent Application No. 10-2017-0005943, filed on Jan. 13, 2017, which is hereby incorporated by reference as if fully set forth herein.

BACKGROUND

1. Field

The present invention relates to a control method of a laundry treatment apparatus.

2. Background

Generally, a laundry treatment apparatus means an apparatus capable of performing drying of laundry, washing of laundry, or both drying and washing of laundry. The apparatus capable of performing drying of laundry includes a drum configured to provide a space for receiving laundry, and a hot air supplier configured to supply heated air (hot air) to the drum.

Generally, control of a conventional laundry treatment apparatus capable of performing drying of laundry is carried out through operation of measuring a dryness of laundry while supplying hot air to the laundry, and stopping supply of hot air when the measured dryness reaches a predetermined dryness.

However, hot air supply to laundry executed in the conventional laundry treatment apparatus is achieved through operation of a fan and a heater in such a manner that operation of the heater is stopped when the internal temperature of a drum reaches a predetermined upper limit, and is again begun when the internal temperature of the drum reaches a predetermined lower limit. Although such a heater control method is advantageous in drying of general laundry, there is a drawback in that damage of laundry may occur upon drying laundry with poor heat tolerance.

BRIEF DESCRIPTION OF THE DRAWINGS

Arrangements and embodiments will be described in detail with reference to the following drawings in which like reference numerals refer to like elements and wherein.

DETAILED DESCRIPTION

Figure 1:
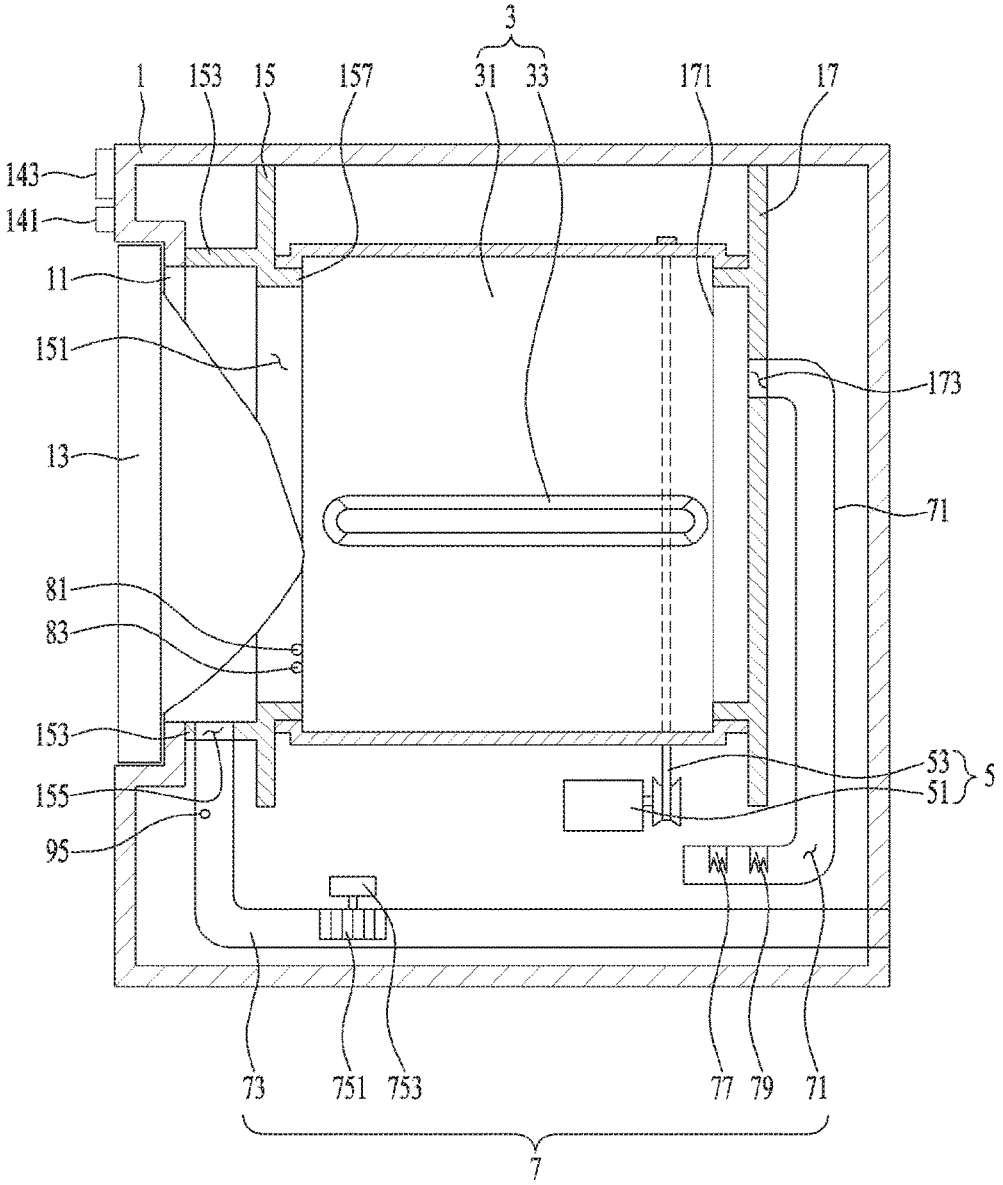
FIG. 1 is a view illustrating a laundry treatment apparatus according to an embodiment of the present invention.

Reference will now be made in detail to the preferred embodiments of the present invention, examples of which are illustrated in the accompanying drawings. Meanwhile, the configuration or control method of an apparatus disclosed herein is illustrated only to explain embodiments of the present invention, and shall not be construed as limiting the scope of the present invention. In addition, the same reference numerals will be used throughout the specification to refer to the same parts.

FIG. 1 illustrates a laundry treatment apparatus according to an embodiment of the present invention. The laundry treatment apparatus, which is designated by reference numeral "100", may include a cabinet 1, a drum 3 rotatably installed in the cabinet 1 and configured to provide a space for storage of laundry, and a hot air supplier 7 configured to supply heated air to the drum 3. The laundry treatment apparatus 100 further includes a dryness sensing unit 81-83 configured to measure a dryness of laundry stored in the drum 3, and a temperature sensing unit 9 configured to measure an internal temperature of the drum 3.

The cabinet 1 is provided with a cabinet opening 11 configured to allow loading of laundry into the drum 3 or unloading of laundry from the drum 3. The cabinet opening 11 may be opened or closed by a door 13 rotatably coupled to the cabinet 1.

In a space provided by the cabinet 1, in detail, a front surface of the cabinet 1 where the cabinet opening 11 is provided, there may be an input unit 141 configured to receive a control command from the user, and a display unit 143 configured to display control commands selectable by the user.

The drum 3 may include a cylindrical drum body 31 having an open front surface and an open rear surface, and a lifter 33 protruding from an inner circumferential surface of the drum body 31 toward a rotation center of the drum body 31.

The drum 3 having the above-described configuration is supported by first and second support members 15 and 17 installed in the cabinet 1. The first support member 15 is fixedly mounted in the cabinet 1, and is configured to rotatably support the front surface of the drum body 31. The second support member 17 is fixedly mounted in the cabinet 1, and is configured to rotatably support the rear surface of the drum body 31.

The first support member 15 includes a drum opening 151 configured to communicate with the cabinet opening 11. Accordingly, the inner space of the drum body 51 communicates with the outside of the cabinet 1 through the drum opening 151 and the cabinet opening 11.

The first support member 15 further includes a front support portion 157 configured to rotatably support the open front surface of the drum body 51. The front support portion 157 may have a ring shape surrounding the drum opening 151.

Meanwhile, the first support member 15 may be fixedly mounted to the open rear surface of the drum body 31 by a connecting portion 153. The connecting portion 153 may have a ring shape surrounding the cabinet opening 11.

The second support member 17 includes a rear support portion 171 configured to rotatably support the open rear surface of the drum body 31. The rear support portion 171 may have a ring shape fitted into the open rear surface of the drum body 31.

The drum 3 is rotated by the driving unit 5. The driving unit 5 may include a motor 51 installed in the cabinet 1, and a belt 53 configured to transmit a rotational force of the motor 51 to the drum body 31.

The hot air supplier 7 configured to supply heated air to the drum 3 may include a supply duct 71 configured to form a flow path introducing ambient air into the drum body 31, and an exhaust duct 73 configured to form a flow path discharging air present in the drum 3 to the outside of the cabinet 1. The hot air supplier 7 may further include a fan provided at the exhaust duct 73, and a heating unit provided at the supply duct 71 and configured to heat air introduced into the supply duct 71.

The fan may include an impeller 751 rotatably installed in the exhaust duct 73, and a fan motor 753 configured to rotate the impeller 751.

The heating unit may include a single motor installed in the supply duct 71. Alternatively, the heating unit may include first and second heaters 77 and 79 configured to operate independently.

The dryness sensing unit 8 may be of any type, so long as the dryness sensing unit 8 can measure the amount of water contained in laundry or the moisture content of laundry (the mass ratio of water to laundry). FIG. 1 illustrates an example in which the dryness sensing unit 8 includes a first terminal 81 fixed to the first support member 15, and a second terminal 83 fixed to the first support member 15 and spaced apart from the first terminal 81. In this case, the first terminal 81 is connected to an anode of a power supply, and the second terminal 82 is connected to a cathode of the power supply. Accordingly, when laundry connects the terminals 81 and 82, electrical communication (flow of current) is achieved.

When wet laundry is maintained in contact with the terminals 81 and 83, current flows between the terminals 81 and 82. When a controller is provided to sense whether or not current flows between the terminals 81 and 82 through laundry (or to sense the value of a voltage supplied for electrical communication), it may be possible to determine whether or not laundry has been loaded in the drum body 31 in accordance with the embodiment of the present invention.

Meanwhile, when the dryness of laundry increases, the amount of moisture contained in the laundry decreases. A decrease in amount of moisture contained in laundry means an increase in resistance of the laundry serving as a circuit connecting two terminals. In this regard, when the controller provided as described above can measure the intensity of current flowing between the terminals 81 and 83 via laundry, the dryness of the laundry can be determined in accordance with the embodiment of the present invention.

The temperature sensing unit 9 may include a temperature sensor configured to directly measure the temperature of laundry. Alternatively, the temperature sensing unit 9 may include a temperature sensor configured to measure the temperature of air exhausted from the drum body 31 and, as such, to indirectly measure the temperature of laundry. FIG. 1 illustrates an example in which the temperature sensing unit 9 is provided at the supply duct 71 and is configured to measure the temperature of air exhausted from the drum body 31.

The above-described embodiment of the present invention illustrates an example in which an air supply path for supplying air to laundry stored in the drum is provided by the supply duct 71 and the exhaust duct 73. However, the air supply path may be configured to form a circulation path (through connection of the supply duct and the exhaust duct).

FIG. 1 illustrates an apparatus for only performing drying of laundry. However, the present invention is also applicable to a laundry treatment apparatus capable of performing both washing and drying of laundry. In this case, a tub (not shown) configured to provide a space for storage of water should be installed in the cabinet, and the drum should be configured to be rotatable within the tub. For rotation of the drum installed in the tub, the driving unit may include a stator fixed to the outside of the tub and configured to generate a rotating magnetic field, a rotor configured to be rotated by the rotating magnetic field generated by the stator, and a rotational shaft extending through the tub to connect the drum and the rotor.

When the driving unit includes the above-described stator, rotor and rotational shaft, the first support member 15 and the second support member 17 may be omitted. Meanwhile, the air supply path should be configured to allow the tub to communicate with the outside of the cabinet. Otherwise, the air supply path should be configured to form a circulation path for circulation of air present in the tub.

Figure 2:
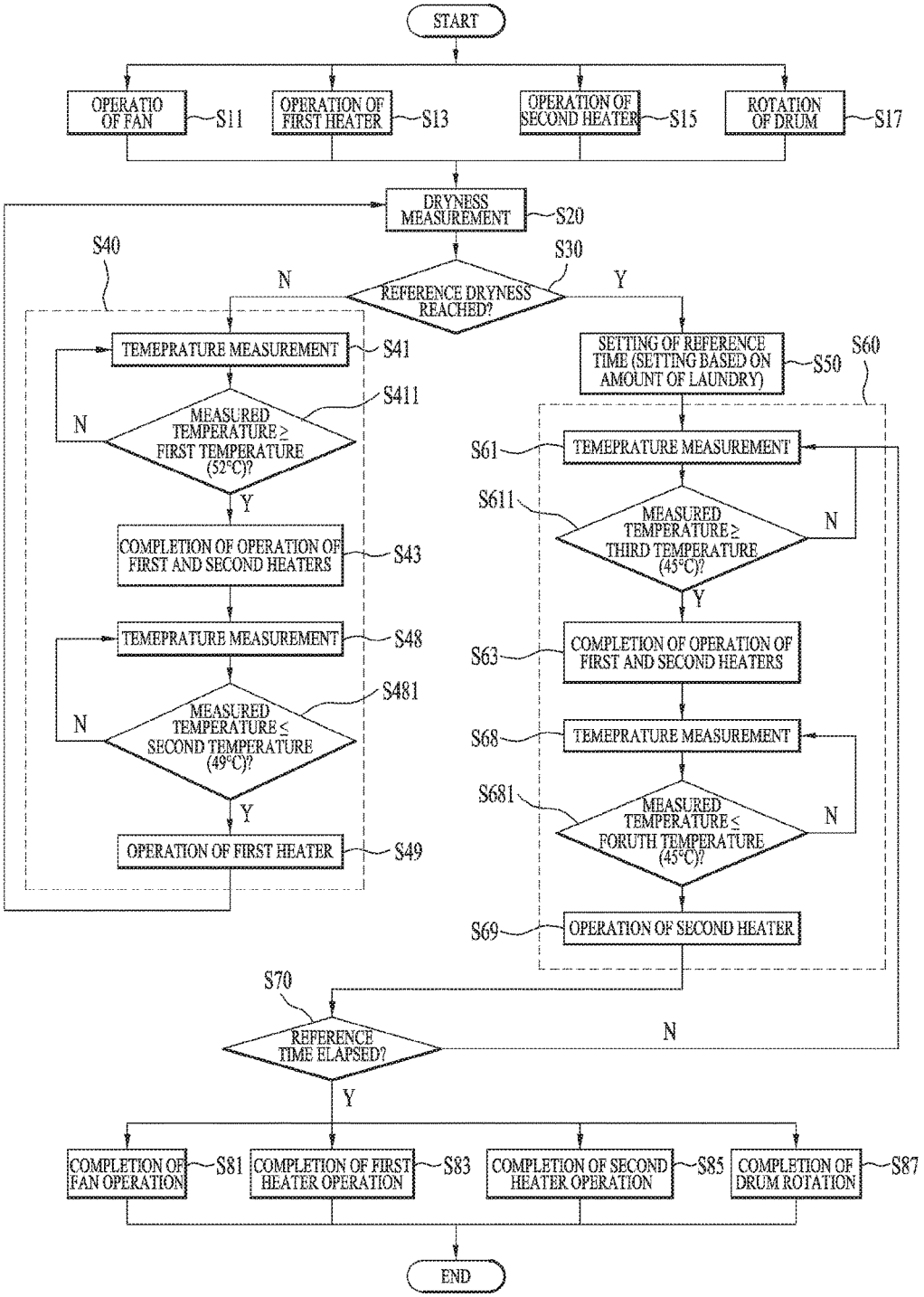
FIG. 2 is a flowchart illustrating a control method of the laundry treatment apparatus according to an embodiment of the present invention.

FIG. 2 illustrates an example of a control method of the laundry treatment apparatus 100 having the above-described configuration. In accordance with an embodiment of the present invention, the control method includes a hot air supply procedure including operations S11, S13 and S15 for supplying heated air to the drum by operating the heating unit, and a dryness measurement procedure S20 for measuring the dryness of laundry through the dryness sensing unit.

The hot air supply procedure includes a fan operation S11 for rotating the impeller 751 through operation of the fan motor 753, a first heater operation S13 for supplying electric power to the first heater 77, and a second heater operation S15 for supplying electric power to the second heater 79.

Of course, when the heating unit equipped in the laundry treatment apparatus includes only one of the first and second heaters 77 and 79, the hot air supply procedure may include the fan operation and one of the heater operations.

The hot air supply procedure may include drum rotation S17 for rotating the drum body 31 through control of the driving unit 5 in order to achieve easy heat exchange between laundry stored in the drum and hot air.

The dryness measurement procedure S20 may be periodically repeated during execution of the hot air supply procedure. In accordance with the control method according to the embodiment of the present invention, it is determined whether or not the dryness measured in the dryness measurement procedure S20 reaches a predetermined reference dryness (S30).

If a current value output when the terminals 81 and 83 are connected by laundry is lower than or equal to a predetermined reference value, the measured dryness may be determined to reach the predetermined reference dryness. Based on the determination, whether or not the measured dryness is equal to or higher than the predetermined reference dryness may be determined.

On the other hand, whether or not the measured dryness is equal to or higher than the predetermined reference dryness may be determined based on the determination that, if the value of a voltage supplied for electrical communication when the terminals 81 and 83 are connected by laundry is equal to or higher than a predetermined reference value, the measured dryness is determined to reach the predetermined reference dryness.

When the measured dryness is determined to be lower than the reference dryness, the control method according to the embodiment of the present invention proceeds to a first heating unit control procedure S40. On the other hand, when the measured dryness is determined to be equal to or higher than the reference dryness, the control method proceeds to a second heating unit control procedure S60.

The first heating unit control procedure S40 includes a temperature measurement operation S41 for measuring the temperature of air exhausted from the drum body by the temperature sensing unit 9, an operation S411 for determining whether or not the measured temperature reaches a predetermined first temperature, and an operation S43 for completing operation of the heating unit when the measured temperature is equal to or higher than the first temperature. The first heating unit control procedure S40 further includes an operation S48 for measuring the temperature of air exhausted from the drum body by the temperature sensing unit 9 after completion of operation of the heating unit, an operation S481 for determining whether or not the air temperature measured after completion of operation of the heating unit reaches a predetermined second temperature, and an operation S49 for operating the heating unit when the air temperature measured after completion of operation of the heating unit is equal to or lower than the second temperature.

The first temperature may be set to a temperature at which damage to cotton laundry is expected. The second temperature is set to be lower than the first temperature. The first and second temperatures may be 52° C. and 49° C., respectively.

When the heating unit includes the first heater 77 and the second heater 79, the operation S43 for completing operation of the heating unit may include an operation of preventing supply of electric power to both the heaters 77 and 79, thereby completing operation of the heaters 77 and 79. In this case, the operation S49 for operating the heating unit may include an operation for supplying electric power to both the heaters 77 and 79, thereby operating the heaters 77 and 79.

On the other hand, when the heating unit includes a single motor alone, the operation S43 for completing operation of the heating unit may include an operation of preventing supply of electric power to the single heater, thereby completing operation of the heater. In this case, the operation S49 for operating the heating unit may include an operation for supplying electric power to the single heater, thereby operating the heater.

Meanwhile, the second heating unit control procedure S40 executed when the dryness measured in the dryness measurement procedure S20 is equal to or higher than the reference dryness includes a temperature measurement operation S61 for measuring the temperature of air exhausted from the drum by the temperature sensing unit, an operation S611 for determining whether or not the measured temperature reaches a predetermined third temperature, and an operation S63 for completing operation of the heating unit when the measured temperature is equal to or higher than the third temperature. The second heating unit control procedure S40 further includes an operation S681 for determining whether or not the temperature measured after completion of operation of the heating unit reaches a predetermined fourth temperature, and an operation S69 for operating the heating unit when the temperature measured after completion of operation of the heating unit is equal to or lower than the fourth temperature.

The third temperature may be set to a temperature lower than the second temperature, and the fourth temperature may be set to a temperature lower than the third temperature. In this case, the third temperature may be set to a temperature at which damage of laundry such as underclothes (laundry expected to be damaged at the second temperature) is expected. The third and fourth temperatures may be 45° C. and 41° C., respectively.

As the reference temperatures for control of the heating unit in the second heating unit control procedure S60 (the third and fourth temperatures) differ from the reference temperatures in the first heating unit control procedure S40 (the first and second temperatures), it may be possible to prevent laundry with poor heat tolerance such as underclothes from being damaged.

In conventional laundry treatment apparatuses, there may a possibility that laundry such as underclothes is damaged, because drying of laundry is carried out only through the first heating unit control procedure S40. In accordance with the embodiment of the present invention, however, upper and lower temperature limits for ON-OFF control of the heating unit are changed when the dryness of laundry reaches the reference dryness and, as such, it may be possible to prevent laundry with poor heat tolerance from being damaged in the drying procedure. To this end, the reference dryness may be set to a dryness corresponding to a moisture content of laundry of 50 to 40%.

When the reference dryness is set to a dryness corresponding to a moisture content of laundry of less than 40%, the execution time of the second heating unit control procedure S60 may be shortened and, as such, the operation time of the laundry treatment apparatus for drying of laundry may be shortened. In this case, however, danger of damage of laundry such as underclothes may increase. On the other hand, when the reference dryness is set to a dryness corresponding to a moisture content of laundry of more than 50%, there may be a problem in that the drying time increases, even though danger of damage to laundry is reduced. In this regard, when reference dryness is set to a dryness corresponding to a moisture content of laundry of 50 to 40%, increase in drying time and danger of damage to laundry may be minimized.

Meanwhile, the second heating unit control procedure S60 may be executed for a reference time set to a time taken until the dryness of laundry reaches the reference dryness. The reference time is set in a completion time setting procedure S50 starting after completion of the procedure S30 for comparing the measured dryness with the reference dryness. The reference time may be set to increase in proportion to the amount of laundry.

When no means for sensing the amount of laundry is provided in the laundry treatment apparatus 100, the completion time setting procedure S50 may set the reference time to be proportional to the time taken until the dryness of laundry reaches the reference dryness.

When the execution time of the second heating unit control procedure S60 reaches the reference time (S70), the control method according to the embodiment of the present invention proceeds to an operation S81 for completing operation of the fan, an operation S83 for completing operation of the first heater, an operation S85 for completing operation of the second heater, and an operation S87 for completing rotation of the drum.

The operation S81 for completing operation of the fan may include an operation for preventing supply of electric power to the fan motor 753 by the controller. The operations S83 and S85 for completing operation of respective heaters may include operations for preventing supply of electric power to respective heaters by the controller, respectively. The operation S87 for completing rotation of the drum may include an operation for preventing supply of electric power to the motor 51 by the controller.

Figure 3:
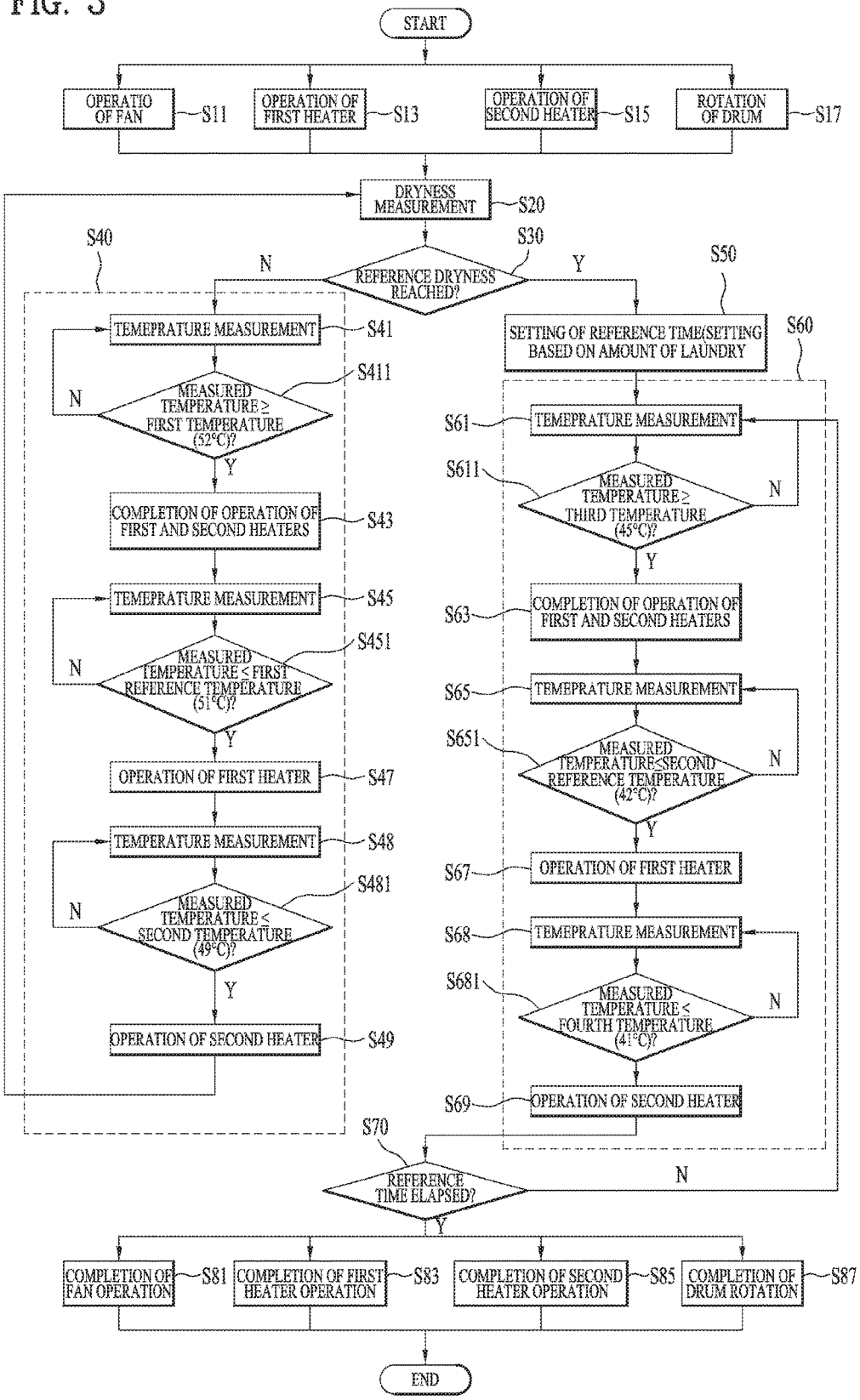
FIG. 3 is a flowchart illustrating a control method of the laundry treatment apparatus according to an embodiment of the present invention.

FIG. 3 illustrates a control method of the laundry treatment apparatus according to another embodiment of the present invention. The control method according to this embodiment has a feature in that the second heating unit control procedure S60 controls the heating unit including the heaters 77 and 79 based on the third temperature, the fourth temperature and a second reference temperature (fifth temperature) set to be lower than the third temperature, but higher than the fourth temperature. Detailed control operations of the procedure will be described hereinafter.

The control method according to this embodiment proceeds to the completion time setting procedure S50 for setting of a reference time when the dryness measured in the dryness measurement procedure S20 is equal to or higher than the reference dryness (S30).

In the control method of this embodiment, the second heating unit control procedure S60 is begun during setting of the reference time for execution of the second heating unit control procedure S60 in the completion time setting procedure S50 or after completion of setting of the reference time.

In accordance with this embodiment, the second heating unit control procedure S60 includes operations S61 and S611 for determining whether or not the temperature of air exhausted from the drum is equal to or higher than the third temperature, and an operation S63 for completing operation of both the first and second heaters 77 and 79 when the measured temperature is equal to or higher than the third temperature.

In accordance with this embodiment, after completion of operation of the first and second heaters 77 and 79, the temperature of air exhausted from the drum is measured (S65). When the temperature measured after completion of operation of both heaters 77 and 79 reaches the fifth temperature (S651), the control method proceeds to an operation S67 for operating only one of the first and second heaters 77 and 79. FIG. 3 illustrates an example in which electric power is supplied only to a selected one of two heaters, namely, the first heater 77.

During operation of the first heater 77 alone, the control method proceeds to an operation S68 for measuring the temperature of air exhausted from the drum. When the temperature measured during operation of the first heater 77 alone is equal to or lower than the fourth temperature (S681), the control method proceeds to an operation S69 for supplying electric power to the second heater 79, thereby operating both the first and second heaters 77 and 79.

Of course, the difference between the third temperature and the fifth temperature may be set to be greater than the difference between the fifth temperature and the fourth temperature (the difference between the fifth temperature and the fourth temperature being set to be lower than the difference between the third temperature and the fifth temperature).

As the difference between the third temperature and the fifth temperature is set to be greater than the difference between the fifth temperature and the fourth temperature, as described above, the time, for which hot air is supplied to the drum 3, may be minimized in accordance with operation of both heaters and, as such, danger of damage of laundry by heat may be minimized.

Meanwhile, as the first heater 77 alone operates at the fifth temperature, it may be possible to minimize the time taken until the temperature of air lowered to the fourth temperature is raised to the third temperature and, as such, increase in drying time may be minimized.

It is experimentally expected that the above-described effects are maximized when the third and fourth temperatures are set to 45° C. and 41° C., respectively, and the fifth temperature is set to 42° C., even though there may be differences thereof in accordance with the kind of laundry, amounts of heat generated from respective heaters, and RPM of the impeller.

In addition, in the control method according to the illustrated embodiment of the present invention, the first heating unit control procedure S40 may control the heating unit including the heaters 77 and 79 based on the first temperature, the second temperature and a first reference temperature (sixth temperature set to be lower than the first temperature, but higher than the second temperature.

The first heating unit control procedure S40 is begun when the dryness measured in the dryness measurement procedure S20 is lower than the reference dryness (S30). In the first heating unit control procedure S40, the temperature measured by the temperature sensing unit 9 is compared with the first temperature (S41 and S411). When the measured temperature is equal to or higher than the first temperature, an operation S43 for completing operation of the first and second heaters 77 and 79 is executed.

In the control method according to the illustrated embodiment, after completion of operation of the first and second heaters 77 and 79, whether or not the temperature measured by the temperature sensing unit 9 reaches the sixth temperature is determined (S45 and S451). When the measured temperature is equal to or lower than the sixth temperature, the control method proceeds to an operation S47 for operating one of the first and second heaters 77 and 79. FIG. 3 illustrates an example in which electric power is supplied only to a selected one of two heaters, namely, the first heater 77.

During operation of the first heater 77 alone (S47), the control method proceeds to an operation S48 for measuring the temperature of air exhausted from the drum. When the temperature measured during operation of the first heater 77 alone is equal to or lower than the second temperature (S481), the control method proceeds to an operation S49 for supplying electric power to the second heater 79, thereby operating both the first and second heaters 77 and 79.

Since laundry contains a large amount of water until the dryness thereof reaches the reference dryness, possibility of damage of the laundry by heat is low in this state, even though air of high temperature is supplied to the laundry in the first heating unit control procedure S40. Meanwhile, for rapid drying of laundry, it is necessary to supply air of high temperature to the laundry. In this regard, the temperature of air supplied to laundry during execution of the first heating unit control procedure S40 may be set to be higher than the temperature of air supplied to laundry during execution of the second heating unit control procedure S60 (average air temperature).

To this end, the difference between the first temperature and the second temperature may be set to be smaller than the difference between the third temperature and the fourth temperature (the difference between the third temperature and the fourth temperature being greater than the difference between the first temperature and the second temperature).

Furthermore, as the operation time of the heating unit including the heaters 77 and 79 increases, there may be advantage in maintaining the interior of the drum at a higher temperature. In addition, as the interior of the drum is maintained at a higher temperature, the drying time of laundry is shortened. In this regard, the difference between the first temperature and the sixth temperature may be set to be smaller than the difference between the sixth temperature and the second temperature. When the first and second temperatures are set to 52° C. and 49° C., respectively, the sixth temperature may be set to 51° C.

When the difference between the first temperature and the sixth temperature is set to be smaller than the difference between the third temperature and the fifth temperature, and the difference between the sixth temperature and the second temperature is set to be greater than the difference between the fifth temperature and the fourth temperature, it may be possible not only to minimize damage of laundry with poor heat tolerance through the second heating unit control procedure S60, but also to minimize increase in drying time through the first heating unit control procedure S40.

After completion of the first heating unit control procedure S40, the control method according to the illustrated embodiment proceeds to the dryness measurement procedure S20 and then to the procedure S30 for comparing the measured dryness with the reference dryness. When the measured dryness is lower than the reference dryness, the first heating unit control procedure S40 is executed again. On the other hand, when the measured dryness is equal to or higher than the reference dryness, the control method according to the illustrated embodiment proceeds to the second heating unit control procedure S60.

After the second heating unit control procedure S60 is executed for the reference time set in the completion time setting procedure S50 (S70), the control method according to the illustrated embodiment proceeds to operations S81, S85 and S87 for completing operation of the fan, operation of the first heater 77, operation of the second heater 79 and rotation of the drum.

As apparent from the above description, the control method of the laundry treatment apparatus may provide an effect of drying laundry with poor heat tolerance without damaging the laundry.

The present invention may also provide a control method of a laundry treatment apparatus wherein control of a hot air supplier executed before a dryness of laundry reaches a predetermined dryness differs from control of the hot air supplier executed after the dryness of the laundry reaches the predetermined dryness.

The control method may also provide an effect of minimizing an increase in drying time even when control of a hot air supplier executed before a dryness of laundry reaches a predetermined dryness differs from control of the hot air supplier executed after the dryness of the laundry reaches the predetermined dryness.

Accordingly, the present invention is directed to a control method of a laundry treatment apparatus that substantially obviates one or more problems due to limitations and disadvantages of the related art.

An object of the present invention is to provide a control method of a laundry treatment apparatus capable of drying laundry with poor heat tolerance without damaging the laundry.

Another object of the present invention is to provide a control method of a laundry treatment apparatus wherein control of a hot air supplier executed before a dryness of laundry reaches a predetermined dryness differs from control of the hot air supplier executed after the dryness of the laundry reaches the predetermined dryness.

Another object of the present invention is to provide a control method of a laundry treatment apparatus capable of minimizing an increase in drying time even when control of a hot air supplier executed before a dryness of laundry reaches a predetermined dryness differs from control of the hot air supplier executed after the dryness of the laundry reaches the predetermined dryness.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry treatment apparatus including a drum configured to provide a space for storage of laundry, an air supply path configured to supply air to laundry stored in the drum, a heating unit disposed in the air supply path and configured to heat air, a temperature sensing unit configured to sense an internal temperature of the drum a temperature of air exhausted from the drum, and a dryness sensing unit configured to measure a dryness of the laundry stored in the drum, includes a hot air supply procedure for supplying heated air to the drum through operation of the heating unit, a dryness measurement procedure for measuring the dryness of the laundry by the dryness sensing unit, a first heating unit control procedure executed when the measured dryness is lower than a predetermined reference dryness, to complete operation of the heating unit when the temperature measured by the temperature sensing unit reaches a predetermined first temperature and to operate the heating unit when the temperature measured by the temperature sensing unit reaches a predetermined second temperature set to be lower than the first temperature, and a second heating unit control procedure executed when the measured dryness is equal to or higher than the predetermined reference dryness, to complete operation of the heating unit when the temperature measured by the temperature sensing unit reaches a predetermined third temperature set to be lower than the second temperature and to operate the heating unit when the temperature measured by the temperature sensing unit reaches a predetermined fourth temperature set to be lower than the third temperature.

The control method may further include a procedure for setting a reference time to increase in proportion to a time taken until the dryness measured by the dryness sensing unit reaches the reference dryness. The second heating unit control procedure may be executed for the reference time.

The heating unit may include a first heater disposed in the air supply path and a second heater disposed in the air supply path, and the hot air supply procedure is executed to operate both the first heater and the second heater. The second heating unit control procedure may include an operation for completing operation of the first and second heaters when the temperature measured by the temperature sensing unit reaches the third temperature, an operation for operating only one of the first and second heaters when a temperature measured after operation of the first and second heaters is completed reaches a fifth temperature set to be between the third temperature and the fourth temperature, and an operation for operating both the first heater and the second heater when a temperature measured while only one of the first and second heaters operates reaches the fourth temperature.

The difference between the fifth temperature and the fourth temperature may be set to be lower than the difference between the third temperature and the fifth temperature.

The third temperature may be set to 45° C., and the fourth temperature is set to 41° C.

The fifth temperature may be set to 42° C.

The first heating unit control procedure may include an operation for completing operation of the first and second heaters when the temperature measured by the temperature sensing unit reaches the first temperature, an operation for operating only one of the first and second heaters when a temperature measured after operation of the first and second heaters is completed reaches a sixth temperature set to be between the first temperature and the second temperature, and an operation for operating both the first heater and the second heater when a temperature measured while only one of the first and second heaters operates reaches the second temperature.

The difference between the third temperature and the fourth temperature may be set to be greater than the difference between the first temperature and the second temperature.

The difference between the first temperature and the sixth temperature may be set to be lower than a difference between the sixth temperature and the second temperature.

The difference between the first temperature and the sixth temperature may be set to be lower than a difference between the third temperature and the fifth temperature.

The difference between the fifth temperature and the fourth temperature may be set to be lower than the difference between the sixth temperature and the second temperature.

Determination as to whether the measured dryness is equal to or higher than the reference dryness may be set in such a manner that the measured dryness is determined to reach the reference dryness when a value of current output when two different terminals provided at the laundry treatment apparatus and spaced apart from each other are connected by the laundry is equal to or lower than a predetermined reference value.

Determination as to whether the measured dryness is equal to or higher than the reference dryness may be set in such a manner that the measured dryness is determined to reach the reference dryness when a value of a voltage supplied for electrical communication when two different terminals provided at the laundry treatment apparatus and spaced apart from each other are connected by the laundry is equal to or higher than a predetermined reference value.

It is to be understood that both the foregoing general description and the following detailed description of the present invention are exemplary and explanatory and are intended to provide further explanation of the invention as claimed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control method of a laundry treatment apparatus that includes a drum, an air supply path configured to supply air to laundry in the drum, a heating device in the air supply path to heat air, a temperature sensor configured to sense a temperature of the drum and a temperature of air from the drum, and a dryness sensor configured to determine a dryness of the laundry in the drum, the method comprising:

a hot air supply procedure for supplying heated air to the drum by using the heating device;

a dryness measurement procedure for determining, by the dryness sensor, the dryness of the laundry;

a first heating control procedure that is executed when the determined dryness is less than a predetermined reference dryness, wherein the first heating control procedure includes to complete operation of the heating device when the temperature sensed by the temperature sensor is equal to or more than a first temperature and to provide operation of the heating device until the temperature sensed by the temperature sensor reaches a predetermined second temperature that is less than the first temperature; and a second heating control procedure that is executed when the determined dryness is equal to or greater than the predetermined reference dryness, wherein the second heating control procedure includes to complete operation of the heating device when the temperature sensed by the temperature sensor is equal to or more than a third temperature that is less than the second temperature and to provide operation of the heating device until the temperature sensed by the temperature sensor reaches a predetermined fourth temperature that is less than the third temperature.

2. The control method according to claim 1, further comprising:

setting a reference time to increase based on a time taken until the dryness determined by the dryness sensor reaches the reference dryness, wherein the second heating control procedure is executed for the reference time.

3. The control method according to claim 2, wherein:

the heating device includes a first heater disposed in the air supply path and a second heater disposed in the air supply path, and the hot air supply procedure is to include operation of both the first heater and the second heater; and the second heating control procedure includes:

completing operation of the first and second heaters when the temperature sensed by the temperature sensor reaches the third temperature, operating only one of the first and second heaters when a temperature sensed after operation of the first and second heaters is completed reaches a fifth temperature that is between the third temperature and the fourth temperature, and operating both the first heater and the second heater when a temperature sensed while only one of the first and second heaters operates reaches the fourth temperature.

4. The control method according to claim 3, wherein a difference between the fifth temperature and the fourth temperature is less than a difference between the third temperature and the fifth temperature.

5. The control method according to claim 3, wherein the third temperature is set to 45° C., and the fourth temperature is set to 41° C.

6. The control method according to claim 5, wherein the fifth temperature is set to 42° C.

7. The control method according to claim 3, wherein the first heating control procedure includes:

completing operation of the first and second heaters when the temperature sensed by the temperature sensor reaches the first temperature;

operating only one of the first and second heaters when a temperature sensed after operation of the first and second heaters is completed reaches a sixth temperature that is between the first temperature and the second temperature; and operating both the first heater and the second heater when a temperature sensed while only one of the first and second heaters operates reaches the second temperature.

8. The control method according to claim 7, wherein a difference between the third temperature and the fourth temperature is greater than a difference between the first temperature and the second temperature.

9. The control method according to claim 7, wherein a difference between the first temperature and the sixth temperature is less than a difference between the sixth temperature and the second temperature.

10. The control method according to claim 7, wherein a difference between the first temperature and the sixth temperature is less than a difference between the third temperature and the fifth temperature.

11. The control method according to claim 7, wherein a difference between the fifth temperature and the fourth temperature is less than a difference between the sixth temperature and the second temperature.

12. A control method of a laundry treatment apparatus that includes a drum, an air supply path configured to supply air to laundry in the drum, a heating device in the air supply path, a temperature sensor configured to sense a temperature, and a dryness sensor configured to determine a dryness of the laundry in the drum, the method comprising:

supplying heated air, by using the heating device, to the drum;

determining, by the dryness sensor, the dryness of the laundry;

when the determined dryness is less than a predetermined reference dryness, complete operating the heating device when the temperature sensed by the temperature sensor is equal to or more than a first temperature and provide operating the heating device until the temperature sensed by the temperature sensor reaches a predetermined second temperature, wherein the second temperature is less than the first temperature; and when the determined dryness is equal to or greater than the predetermined reference dryness, complete operating the heating device when the temperature sensed by the temperature sensor is equal to or more than a third temperature that is less than the second temperature and provide operating the heating device until the temperature sensed by the temperature sensor reaches a predetermined fourth temperature, wherein the fourth temperature is less than the third temperature.

13. The control method according to claim 12, further comprising:

setting a reference time based on a time taken until the dryness determined by the dryness sensor reaches the reference dryness.

14. The control method according to claim 12, wherein:

the heating device includes a first heater in the air supply path and a second heater in the air supply path, and the supplying of the heated air includes operating both the first heater and the second heater; and wherein when the determined dryness is equal or greater than the predetermined reference dryness includes:

operating the first and second heaters when the temperature sensed by the temperature sensor reaches the third temperature, operating only one of the first and second heaters when a temperature sensed after the operating of the first and second heaters is completed reaches a fifth temperature that is between the third temperature and the fourth temperature, and operating both the first heater and the second heater when a temperature sensed while the operating of only one of the first and second heaters reaches the fourth temperature.

15. The control method according to claim 14, wherein a difference between the fifth temperature and the fourth temperature is less than a difference between the third temperature and the fifth temperature.

16. The control method according to claim 14, wherein the third temperature is set to 45° C., and the fourth temperature is set to 41° C.

17. The control method according to claim 16, wherein the fifth temperature is set to 42° C.

18. The control method according to claim 14, wherein when the determined dryness is less than a predetermined reference dryness includes:

operating the first and second heaters when the temperature sensed by the temperature sensor reaches the first temperature;

operating only one of the first and second heaters when a temperature sensed after the operating of the first and second heaters is completed reaches a sixth temperature, wherein the sixth temperature is between the first temperature and the second temperature; and operating both the first heater and the second heater when a temperature sensed while the operating of only one of the first and second heaters reaches the second temperature.

19. The control method according to claim 18, wherein a difference between the third temperature and the fourth temperature is greater than a difference between the first temperature and the second temperature.

20. The control method according to claim 18, wherein a difference between the first temperature and the sixth temperature is less than a difference between the sixth temperature and the second temperature.

* * * * *